US008167574B2

(12) United States Patent
Ko

(10) Patent No.: US 8,167,574 B2
(45) Date of Patent: May 1, 2012

(54) CEIL FAN BLADE ASSEMBLY

(76) Inventor: Ching-Yang Ko, Changhua (TW)

( * ) Notice: Subject to any disclaimer, the term of this patent is extended or adjusted under 35 U.S.C. 154(b) by 0 days.

(21) Appl. No.: 12/276,311

(22) Filed: Nov. 22, 2008

(65) Prior Publication Data

US 2011/0070091 A1 Mar. 24, 2011

(51) Int. Cl.

| | |
|---|---|
| ***B64C 11/04*** | (2006.01) |
| ***F03B 3/12*** | (2006.01) |
| ***F03B 7/00*** | (2006.01) |
| ***F04D 29/34*** | (2006.01) |
| ***F04D 29/38*** | (2006.01) |
| ***B63H 1/26*** | (2006.01) |
| ***B63H 7/02*** | (2006.01) |
| ***B64C 11/16*** | (2006.01) |
| ***B64C 27/46*** | (2006.01) |
| ***F01D 5/14*** | (2006.01) |
| ***F03D 11/02*** | (2006.01) |

(52) U.S. Cl. ..... 416/229 R; 416/210 R

(58) Field of Classification Search ..... None
See application file for complete search history.

(56) References Cited

U.S. PATENT DOCUMENTS 5,601,409 A * 2/1997 Huang ..... 416/229 R
2006/0018755 A1 * 1/2006 Kistner et al. ..... 416/210 R

* cited by examiner

*Primary Examiner* — Michael Lebentritt
*Assistant Examiner* — Valerie N Brown
(74) *Attorney, Agent, or Firm* — Jackson IPG PLLC; Demian K. Jackson

(57) ABSTRACT

A ceil fan blade assembly includes an upper blade, a lower blade, and a decorative member enclosed between the upper and lower blades. The upper and lower blades are formed with engaging portions which are an engaging rib and en engaging groove to connect the upper and lower blades together. Each of the upper and lower blades is formed with an inner recess at the middle and rear sections thereof so as to enclose the decorative member. The decorative member is made of colored paper, plastic material or embossment board. The upper and lower blades are connected tightly to become one piece after high frequency or ultrasonic process. The surface of the decorative member is printed or carved with a patter to be reflected through the inner recesses. This provides a simply and easy way and is cost-effective.

8 Claims, 4 Drawing Sheets

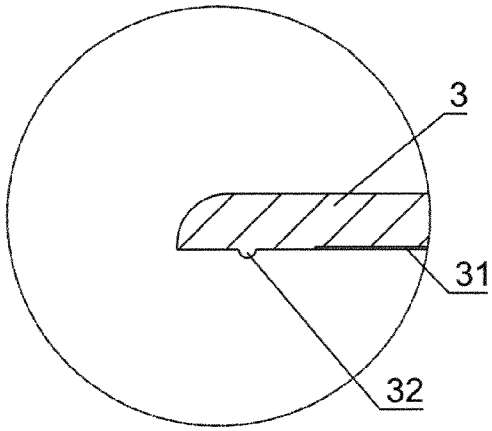
Fig. 2-A
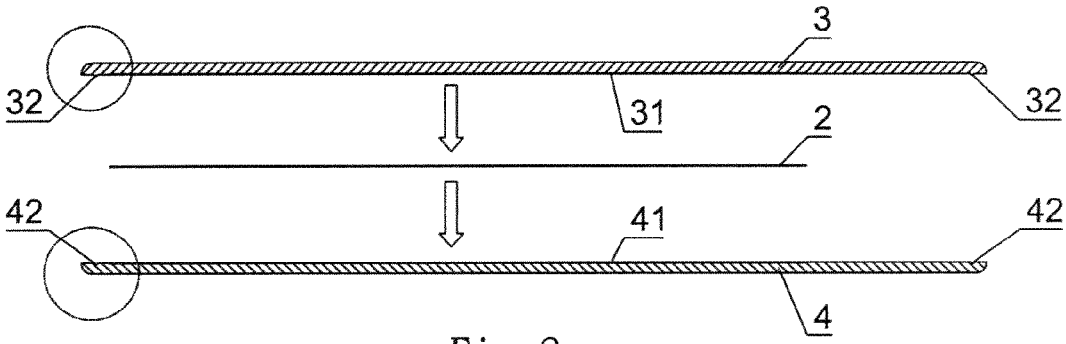
Fig. 2
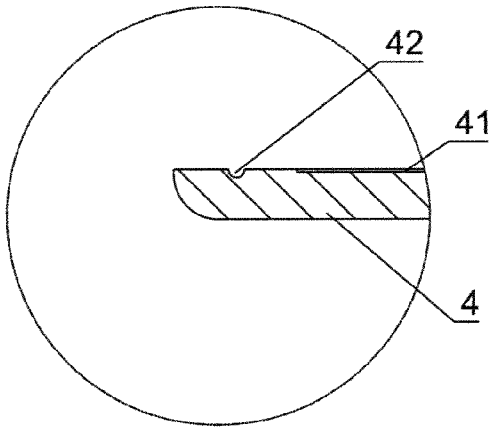
Fig. 2-B

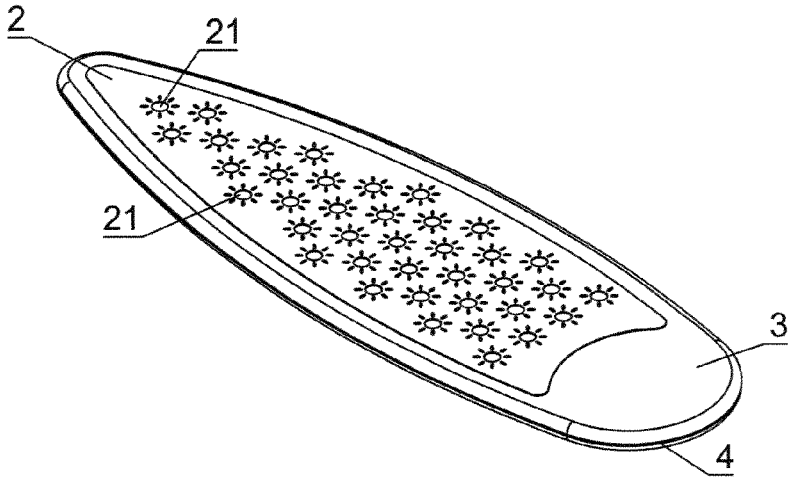
Fig. 3
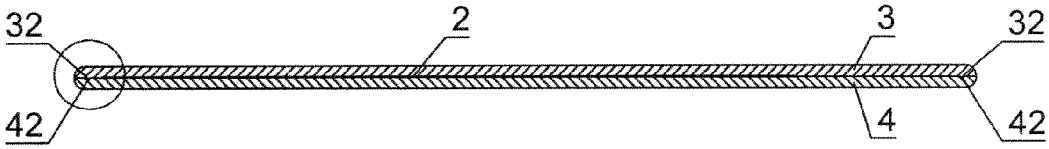
Fig. 4
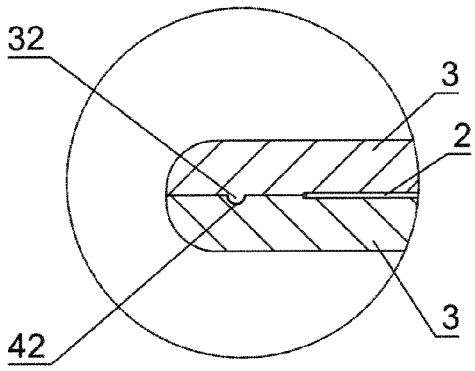
Fig. 4-A

Fig. 5-A

CEIL FAN BLADE ASSEMBLY

BACKGROUND OF THE INVENTION

1. Field of the Invention

The present invention relates to a ceil fan blade assembly, and more particularly to one having an upper blade, a lower blade, and a decorative member enclosed between inner recesses of the upper and lower blades. The upper and lower blades are formed with engaging portions which are an engaging rib and en engaging groove to connect the upper and lower blades together. The upper and lower blades are connected tightly to become one piece after high frequency or ultrasonic process. The surface of the decorative member is printed or carved with a patter to be reflected through the inner recesses. This provides a simply and easy way to manufacture the blade.

2. Description of the Prior Art

A conventional ceil fan blade 5 is made of wood, as shown in FIG. 6. The surface of the blade 5 is coated with painting to produce difference pattern 51 for change, which has high production, is unable to have mass production, and lowers its competition.

SUMMARY OF THE INVENTION

According to the present invention, there is provided ceil fan blade assembly, comprising:

a decorative member, made of colored paper printed or carved with a pattern;

an upper blade, made of plastic material, the upper blade having an open side facing downward, an inner recess at middle and rear sections thereof, and an engaging portion around a circumferential portion of the upper blade;

a lower blade, made of plastic material, the lower blade having an open side facing upward, an inner recess at middle and rear sections thereof, and an engaging portion around a circumferential portion of the upper blade;

thereby, the engaging portion of the upper blade engaging with the engaging portion of the lower blade, the inner recesses of the upper and lower blades enclosing the decorative member, the upper blade and the lower blade being connected tightly to become one piece through high frequency or ultrasonic process, the pattern of the decorative member being reflected through the inner recesses.

BRIEF DESCRIPTION OF THE DRAWINGS

FIG. 2 is a sectional view of the present invention;

FIG. 2-A is a sectional view showing an upper blade with an engaging rib of the present invention;

FIG. 2-B is a sectional view showing a lower blade with an engaging groove of the present invention;

FIG. 3 is a perspective view of the present invention;

FIG. 4 is a sectional view of a first preferred embodiment of the present invention;

FIG. 4-A is a partially sectional view of the first preferred embodiment of the present invention;

FIG. 5-A is a partially sectional view of the second preferred embodiment of the present invention.

DETAILED DESCRIPTION OF THE PREFERRED EMBODIMENT

Figure 1:
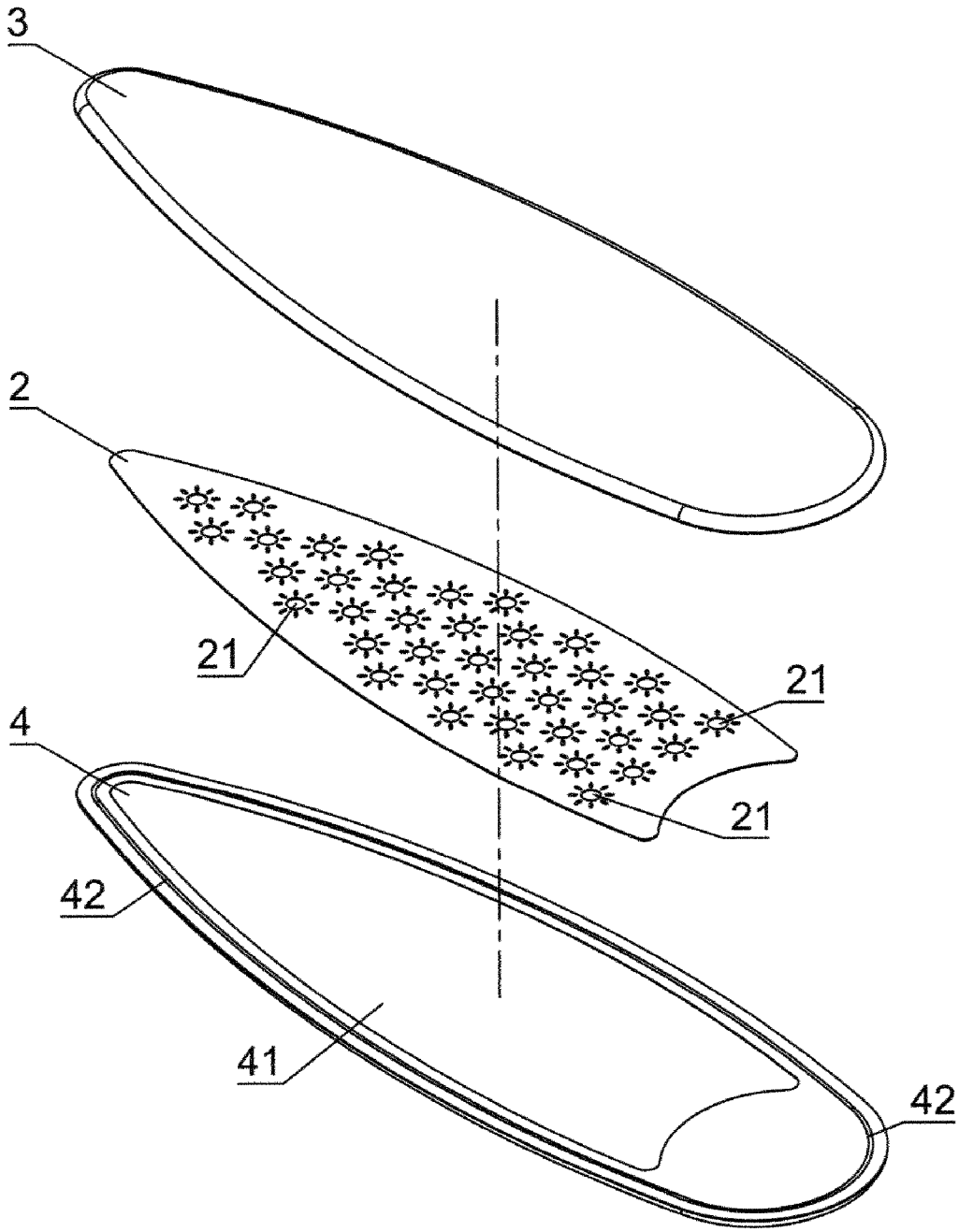
FIG. 1 is an exploded view of the present invention.

As shown in FIG. 1 and FIG. 3, the present invention comprises a decorative member 2, an upper blade 3, and a lower blade 4 which are coupled together.

The decorative member 2 is a sheet made of colored paper, plastic material, or embossment board. The decorative member 2 is disposed between inner recesses 31 and 41 of the upper blade 3 and the lower blade 4, and corresponds in shape and in size to the inner recesses 31 and 41. The surface of the decorative member 2 is printed or carved with a pattern 21. The pattern 21 is in the form of flowers, stars, figures and so on.

The upper blade 3 is made of plastic material, and has an open side facing downward. The upper blade 3 has middle and rear sections larger than a front section thereof for accommodating the decorative member 2. The upper blade 3 is formed with an engaging portion which is an engaging rib 32 or an engaging groove 33 around its periphery.

The lower blade 4 is also made of plastic material, and has an open side facing upward. The lower blade 4 has middle and rear sections larger than a front section thereof for accommodating the decorative member 2. The lower blade 4 is formed with an engaging portion which is an engaging groove 42 or an engaging rib 43 around its periphery for coupling with the upper blade 3.

As shown in FIG. 2, FIG. 2-A, FIG. 2-B, and FIG. 3, the decorative member 2 having flowers pattern is placed in the inner recess 41 of the lower blade 4. The upper blade 3 covers the decorative member 2. The engaging rib 32 of the upper blade 3 engages with the engaging groove 42 of the lower blade 4. After high frequency or ultrasonic process, the upper blade 3 and the lower blade 4 are connected tightly to become one piece. The inner recess 31 of the upper blade 3 corresponds in position to the inner recess 41 of the lower blade 4 for enclosing the decorative member 2. By the inner recesses 31 and 41 of the upper and lower blades 3 and 4, the printed or carved pattern 21 on the decorative member 2 is reflected. This provides a simple and quick way to manufacture a ceil fan blade having the pattern 21, which is cost-effective.

Figure 5:
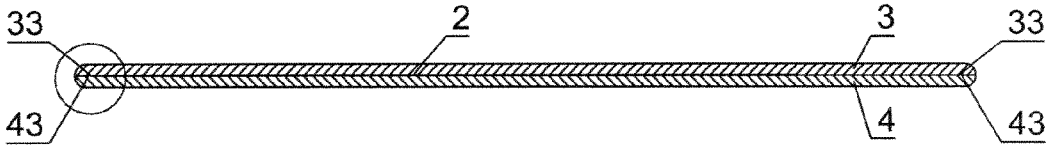
FIG. 5 is a sectional view of a second preferred embodiment of the present invention.
Figure 6:
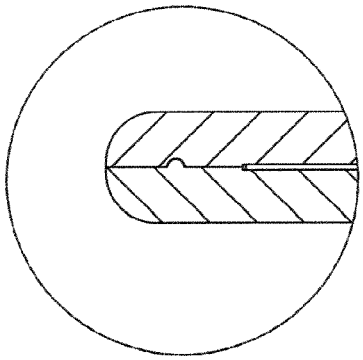
Fig. 6 (PRIOR ART)
FIG. 6 is perspective view of the prior art.
Figure 6:
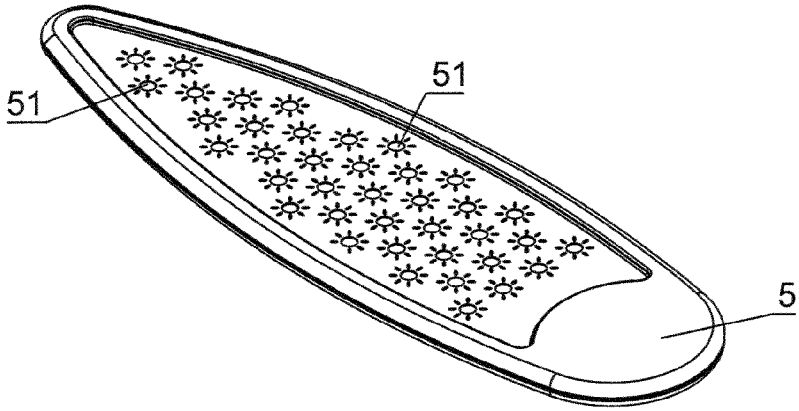
Fig. 6 (PRIOR ART)

As shown in FIG. 4, FIG. 4-A, FIG. 5, and FIG. 5-A, the aforesaid preferred embodiment has the engaging groove 42 of the lower blade 4 to engage with the engaging rib 32 so the inner recesses 31 and 41 enclose the decorative member 2, as shown in FIG. 4 and FIG. 4-A. As shown in FIG. 5 and FIG. 5-A, a second preferred embodiment is substantially similar to the aforesaid first preferred embodiment with the exceptions described hereinafter. The engaging rib 43 of the lower blade 4 engages with the engaging groove 33 of the upper blade 3, and the inner recesses 31 and 41 correspond in position with each other to enclose the decorative member 2. This also provides a simple way for manufacture.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A ceiling fan blade assembly, comprising:

a decorative member, made of colored paper printed or carved with a pattern;

an upper blade, made of plastic material, the upper blade having an upper surface and an open side facing downward, an inner recess having a bottom surface extending at middle and rear sections thereof, and an engaging portion around a circumferential portion of the upper blade; and a lower blade, made of plastic material, the lower blade having a lower surface and an open side facing upward, an inner recess having a bottom surface extending at middle and rear sections thereof, and an engaging portion around a circumferential portion of the lower blade; thereby, the engaging portion of the upper blade engaging with the engaging portion of the lower blade, the inner recesses of the upper and lower blades enclosing the decorative member, and such that the upper blade and the lower blade are one piece through a high frequency or ultrasonic process, and such that the pattern of the decorative member is reflected through the inner recesses.

2. A ceiling fan blade assembly as claimed in claim 1, wherein the decorative member is made of plastic material.

3. A ceiling fan blade assembly as claimed in claim 1, wherein the decorative member is made of embossment board.

4. A ceiling fan blade assembly as claimed in claim 1, wherein the pattern is in the form of flowers, stars, or figures.

5. A ceiling fan blade assembly as claimed in claim 1, wherein the engaging portion the upper blade is an engaging rib, and the engaging portion of the lower blade is an engaging groove.

6. A ceiling fan blade assembly as claimed in claim 1, wherein the engaging portion the upper blade is an engaging groove, and the engaging portion of the lower blade is an engaging rib.

7. A ceiling fan blade assembly as claimed in claim 1, wherein the decorative member is displayed through the upper surface of the upper blade.

8. A ceiling fan blade assembly as claimed in claim 1, wherein the decorative member is displayed through the lower surface of the lower blade.

* * * * *